US006234721B1

(12) United States Patent
Cronkhite et al.

(10) Patent No.: US 6,234,721 B1
(45) Date of Patent: May 22, 2001

(54) EROSION PREVENTION BLOCK

(75) Inventors: Gregory A. Cronkhite; John J. Bonanti, both of Fairview, PA (US)

(73) Assignee: Earth Solutions, Inc., Erie, PA (US)

( * ) Notice: Subject to any disclaimer, the term of this patent is extended or adjusted under 35 U.S.C. 154(b) by 0 days.

(21) Appl. No.: 09/466,729

(22) Filed: Dec. 17, 1999

(51) Int. Cl.[7] ..... E02D 29/02
(52) U.S. Cl. ..... 405/284; 52/610
(58) Field of Search ..... 405/262, 284, 405/285, 286; 52/609, 610, 604, 607, 605

(56) References Cited

U.S. PATENT DOCUMENTS 4,244,665 * 1/1981 Neumann ..... 405/286
4,524,551 * 6/1985 Scheiwiller ..... 405/286
4,613,255 * 9/1986 Bruer ..... 405/286
4,671,706 * 6/1987 Giardini ..... 405/286
5,658,098 * 8/1997 Woolbright ..... 405/284
5,806,249 * 9/1998 Helms ..... 405/284
5,975,809 * 11/1999 Taylor et al. ..... 405/262
6,062,772 * 5/2000 Perkins ..... 405/284

* cited by examiner

*Primary Examiner*—David Bagnell
*Assistant Examiner*—Frederick L. Lagman
(74) *Attorney, Agent, or Firm*—Richard K. Thomson

(57) ABSTRACT

A hollow, L-shaped plastic block has a protrusion on a first end and a recess on the opposite end which fit together to form a retaining wall. A rod extends between openings in the protrusion and the recess to secure adjacent blocks against lateral movement. Alternating ribs and grooves are formed in two laterally extending surfaces and a horizontally extending surface to reinforce them against bulging and to provide passageways for runoff. Rebar is used to attach the blocks to the underlying and adjacent soil. A hole may be cored in an upper surface, fill selected from the group of sand, soil, rock, cement and water inserted, and the cored plug reattached using spin welding.

14 Claims, 5 Drawing Sheets

EROSION PREVENTION BLOCK

BACKGROUND AND SUMMARY OF THE INVENTION

The present invention is directed to the field of erosion prevention. More particularly, the present invention is directed to a light weight, erosion prevention block which can be manufactured in a plurality of colors for enhanced versatility in landscaping.

Preventing water from carrying off soil is particularly of concern around lakes, ponds, streams, rivers and oceans. The construction of barriers may be as a part of a flood control effort or simply a retaining wall to prevent erosion caused by normal water flow. However, any place that soil is at risk to be carried off by runoff, such as on hillsides or where fresh dirt is placed as a part of a landscaping effort, erosion prevention of one sort or another should be employed.

Erosion prevention blocks have been developed as a means to restrict or eliminate soil removed by water flow. These blocks are typically made of cement in order to provide adequate mass to prevent their shifting. In addition, these blocks typically include some means to interlock adjacent blocks to restrict movement between them since movement could undermine the integrity of the retaining wall. Because of their mass (size and density), these blocks are difficult to handle and place. They also pose a threat to the workmen, risks of both muscle strain as well as damage due to impact. In some cases, the mass of the blocks require the use of a crane or other equipment to allow their manipulation and placement.

The erosion prevention block of the present invention overcomes these difficulties. The block itself is an L-shaped hollow container molded of a highly durable plastic (e.g., polyethylene) providing light weight so that it can easily be positioned by a workman. Each block has first and second means which interengage to connect adjacent blocks to form a retaining wall. Once in place, the blocks are bulked up by filling the hollow interior with whatever fill material is readily available including, but not limited to, rock, sand, soil, cement or, in certain instances, water. This can be accomplished by cutting an opening in a top portion of the block using a boring tool. The plug thus created is retained for subsequent use. The fill can be pumped into the L-shaped container and the plug reset using spin welding.

The lateral walls of the container are equipped with alternating ribs and grooves. The ribs provide structural rigidity against the fill which would otherwise cause the walls to belly out. The grooves provide runoff passageways for water flowing over the surfaces. Passageways on the base of the block provide openings for receiving rebar to enable the blocks to be anchored to a hillside, or the like. Vertically extending rebar anchors the first course of blocks to the supporting soil and may also be used to attach the first course to a second and/or subsequent course of blocks.

The first and second connecting means can take the form of a protrusion on a first end of the block and a complementary recess on the opposite end. A bar, which may take the form of a length of pvc pipe, extends vertically between an opening in the protrusion and an opening in the recess to maintain the blocks adjacent to one another. The blocks can be offset stacked to produce a terraced upper surface and soil, dirt or rocks used to backfill against the retaining wall. By laterally offsetting one course from the previous course of blocks, the seams are offset so as not to create a flow passage for water to create a continuous valley.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
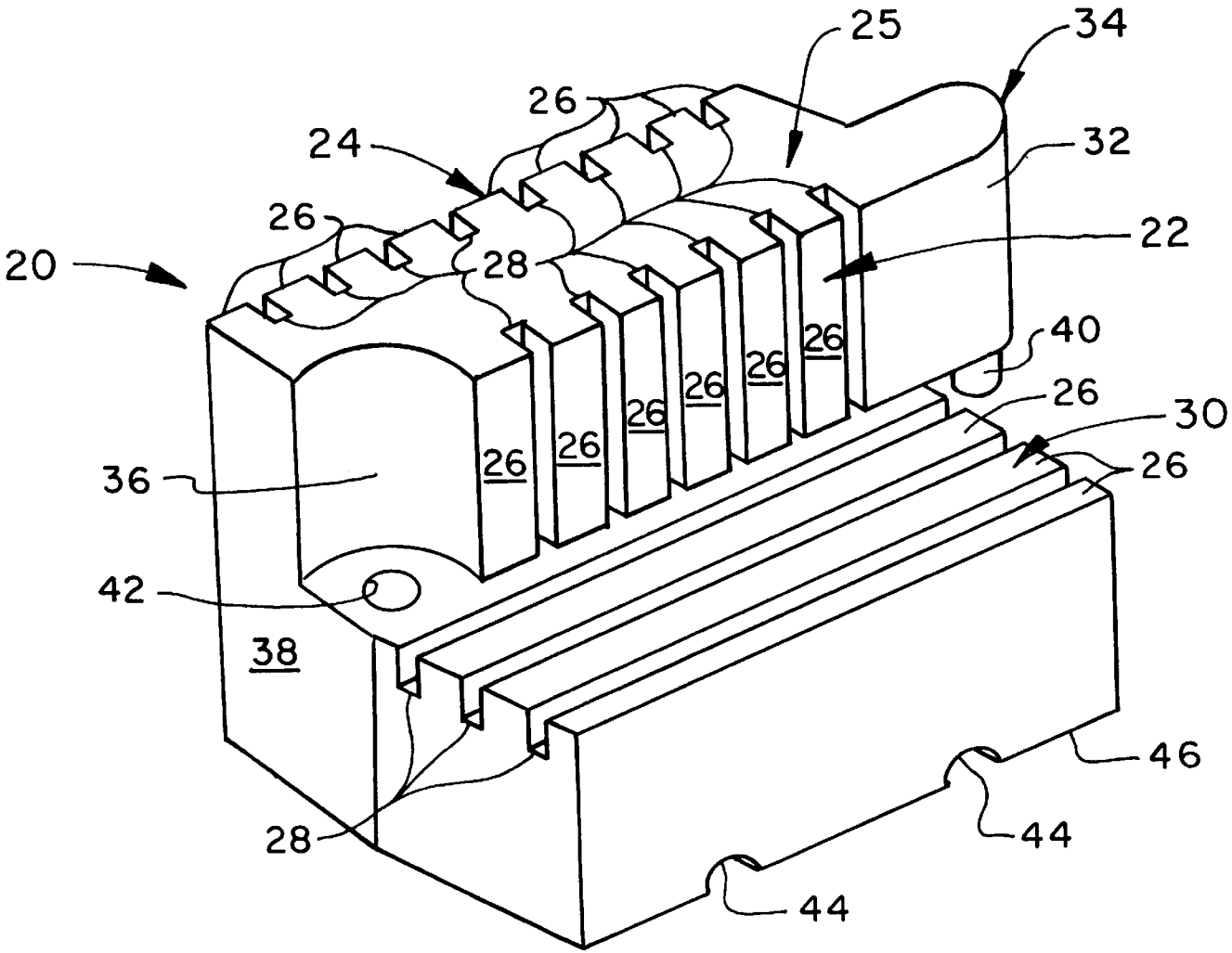
FIG. 1 is a perspective view of a first embodiment of the erosion prevention block of the present invention.

The light weight, erosion prevention block of a first embodiment of the present invention is shown in FIGS. 1–4 generally at 20. Erosion prevention block 20 is generally L-shaped in lateral cross section having a pair of spaced vertically extending walls defining a first arm of the L-shape and a top and bottom defining a second arm of the L-shape and two side walls creating an enclosed hollow interior and being made of a durable plastic such as, for example, polyethylene. An additional benefit of using plastic is that any of a variety of pigments can be added to provide an aesthetically pleasing appearance to the retaining wall. At least two laterally extending faces 22 and 24 are formed with alternating ridges 26 and grooves 28. Ridges 26 provide structural reinforcement to prevent the fill material from causing faces 22 and 24 from bellying outwardly, while grooves 28 provide passageways for water to runoff the block. Upwardly facing surface 30 is also provided with alternating ridges 26 and grooves 28 for the same reasons. First means in the form of protrusion 32 is formed on first end 34 of block 20 and a complimentarily shaped recess 36 forms a second means for securing adjacent blocks 20 together on second end 38. A rod 40 extends between a first opening (not shown) in protrusion 32 and a second opening 42 in recess 36. This rod 40, which may preferably take the form of a length of appropriate diameter pvc pipe, prevents movement between adjacent blocks 20 placed to form a retaining wall.

Figure 2:
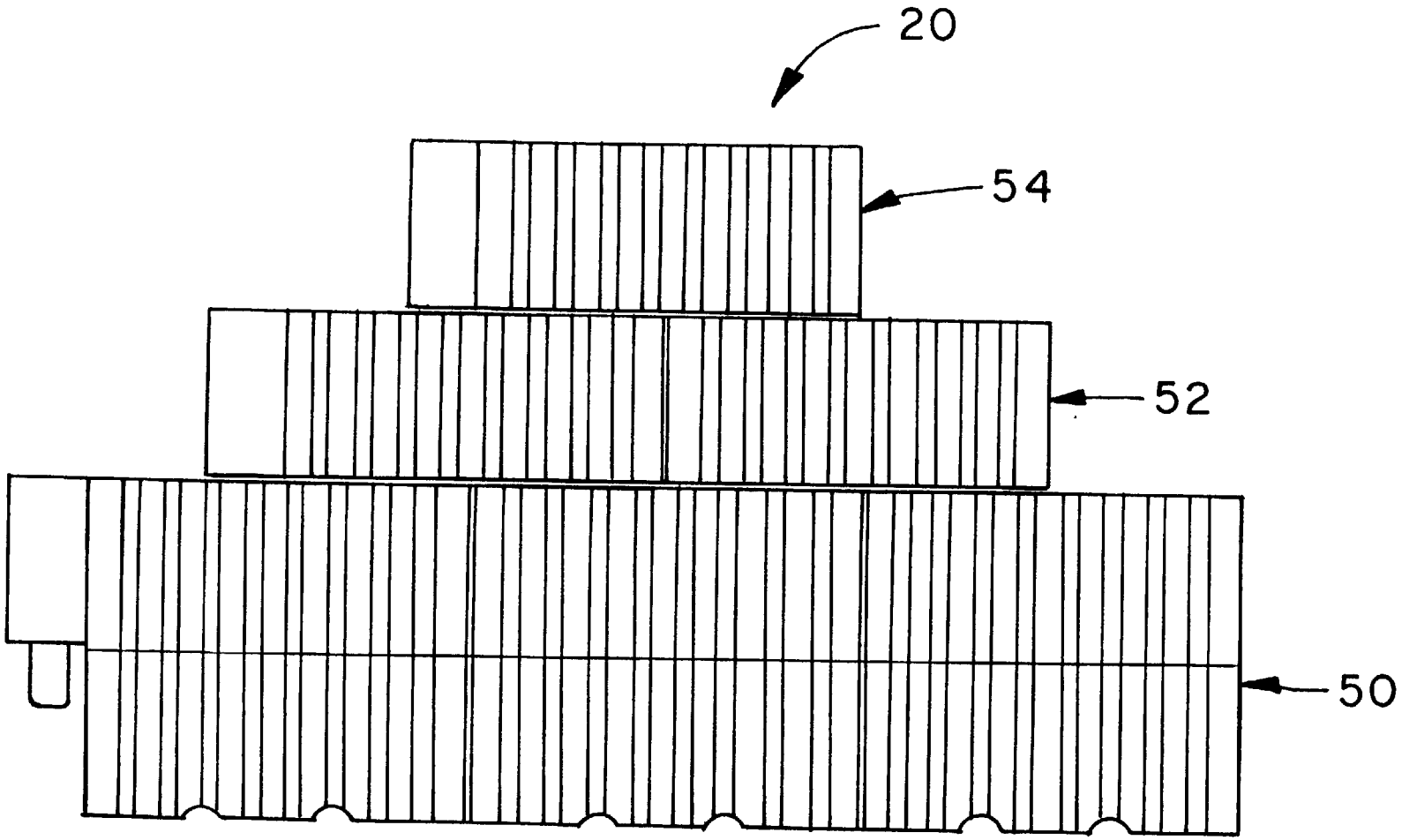
FIG. 2 is a back view of the first embodiment of erosion control block.
Figure 3:
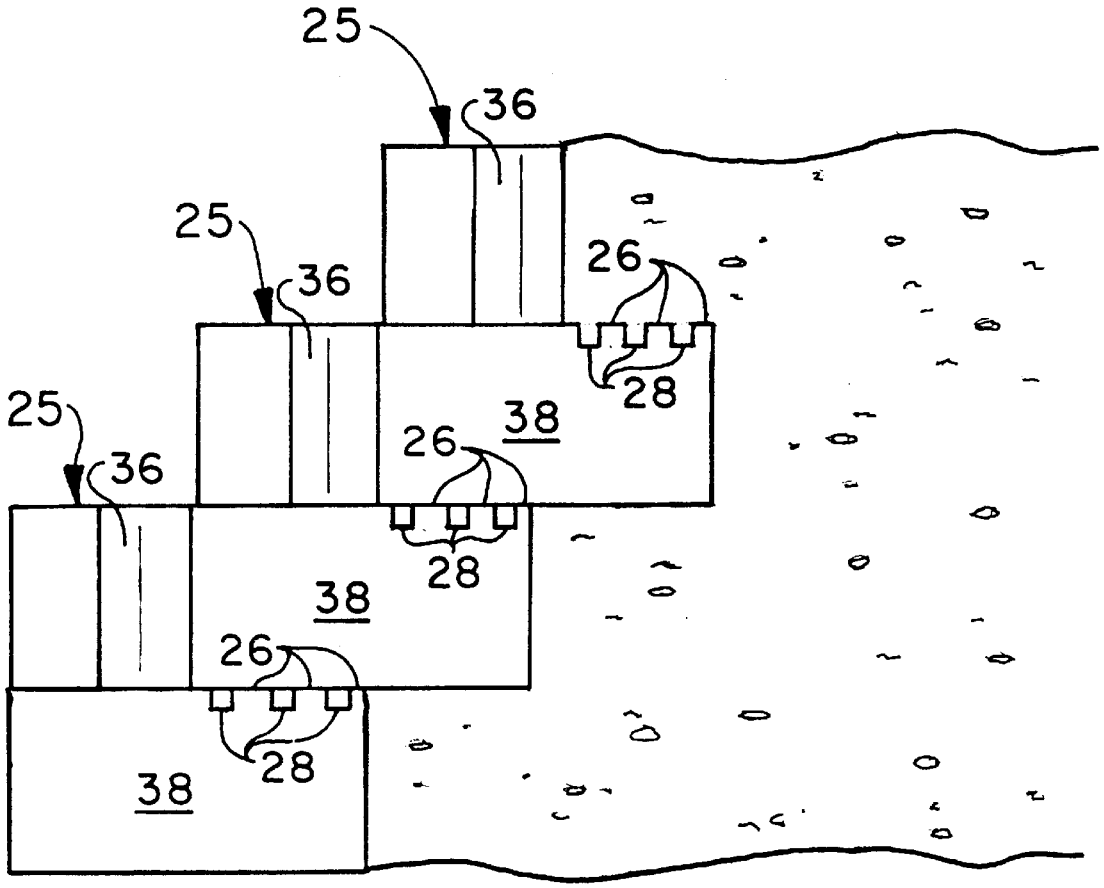
FIG. 3 is a side view of the first embodiment.
Figure 4:
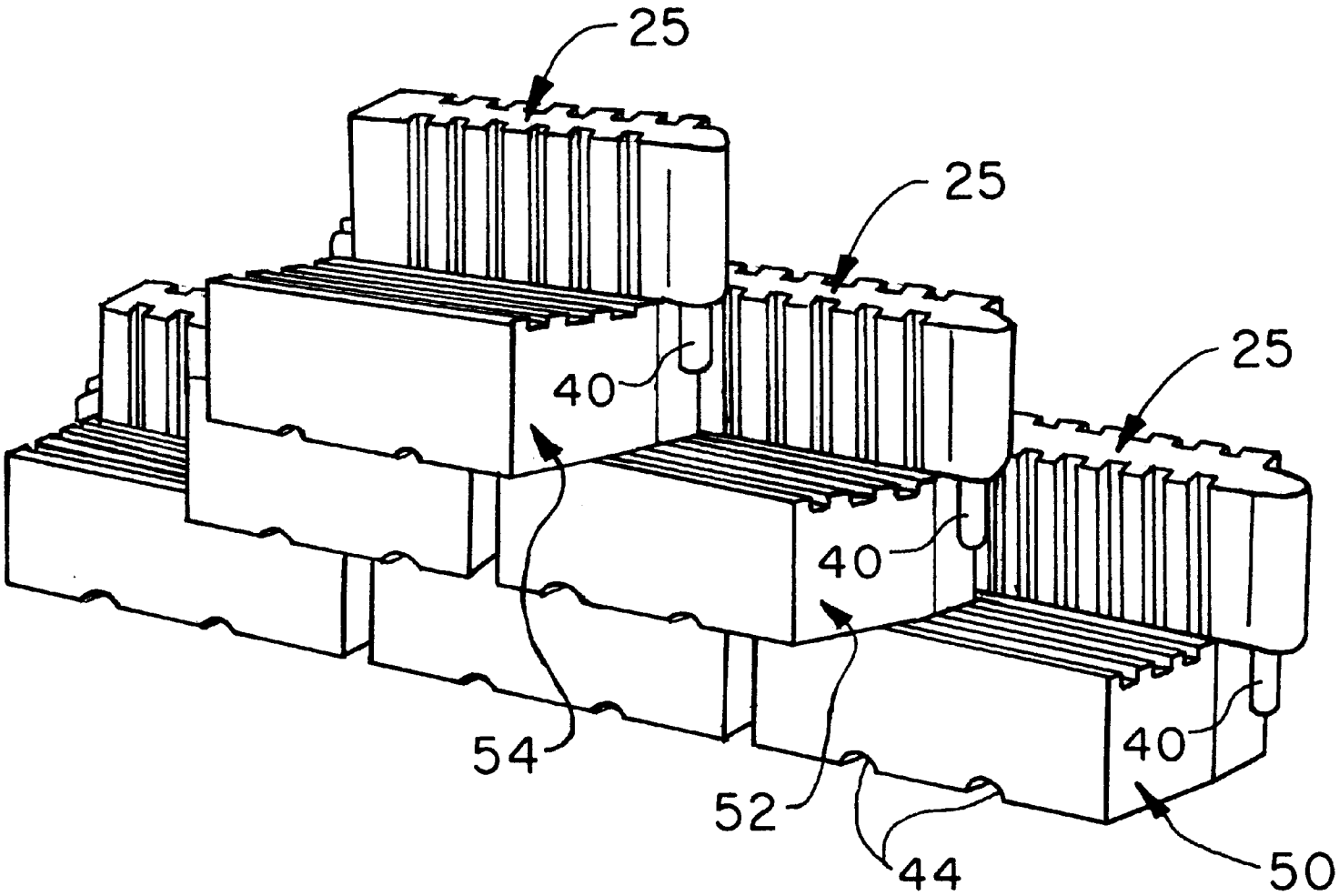
FIG. 4 is a perspective front view showing how the blocks are linked.
Figure 5:
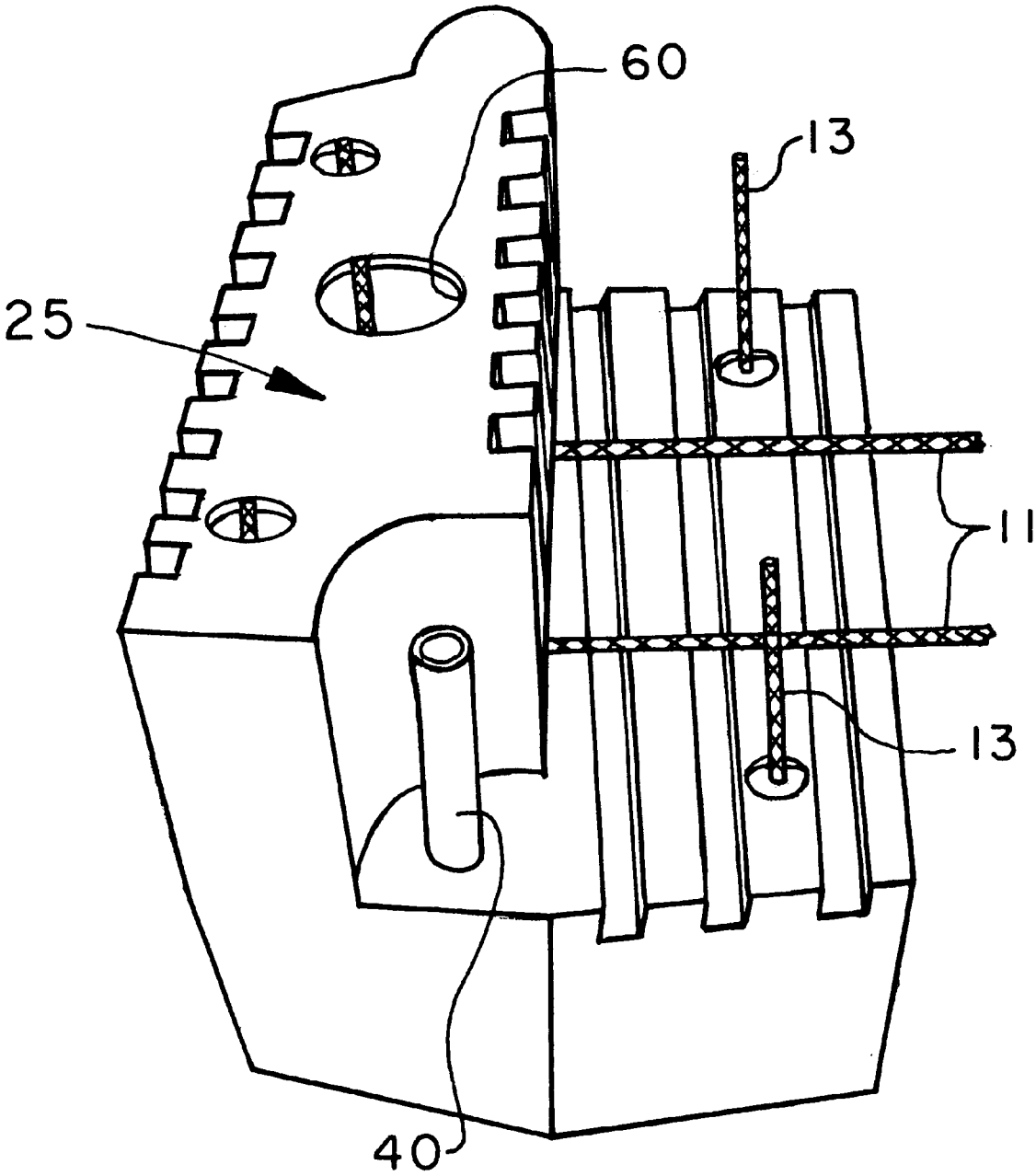
FIG. 5 is a perspective view showing how the blocks are attached to the ground.

A pair of channels 44 extending across the base 46 of block 20 provide passages for rebar 11 (FIG. 5) which is anchoring the top portion 25 of block 20 into a hillside, or the like. Rebar 13 can also be used to anchor blocks 20 into the supporting soil therebeneath, as well as anchor a subsequently positioned course 52 of blocks 20 to a previously positioned course 50, as well as extending laterally between adjacent blocks. Courses 50, 52, 54, etc., can be offset stacked to create a terraced upper surface. As seen in FIG. 2, courses 52 and 54 are laterally offset as is done with bricks, blocks and the like, in order to enhance the strength of the retaining wall and help avoid the creation of a flow path which could permit runoff to erode a valley in the retained soil.

In forming a retaining wall, a first course or tier 50 of blocks 20 is interconnected using rods 40 in the openings formed in protrusions 32 and recesses 36 to secure them together. Rebar 11 and 13 is used to secure the first tier to the soil. Subsequent tier 52 is offset stacked upon first tier 50 and tier 54 on tier 52 to create a terraced upper surface, with the seams between adjacent blocks 20 in subsequent tiers being offset relative to the previous tier. Rebar may be used to connect blocks 20 laterally if additional strength is needed. Holes 60 can be formed in the upper surface of upper portions 25 of each block 20 and fill added to provide mass for the retaining wall after the blocks 20 have been positioned as desired. Fill material may be selected from the group consisting of sand, soil, rock, cement, and in flood control situations, water. Additional steps need to be taken to seal all holes through the walls, around the rebar 11 and 13 and the like, when water is used. Once the container which the block 20 forms is filled, the plugs cored out to form holes 60 can be replaced using spin (or friction) welding, or the like, to complete the enclosure and retain the fill.

Various changes, alternatives and modifications will become apparent to one of ordinary skill in the art following a reading of the foregoing specification. It is intended that any such changes, alternatives and modifications as fall within the scope of the appended claims be considered part of the present invention.

We claim:

1. A block for use in controlling soil erosion comprising a) a light-weight, generally L-shaped, hollow block of rigid, durable plastic, said hollow block including a pair of spaced vertical extending walls defining a first arm of an L-shape, and a top and bottom defining a second arm of the L-shape and two side walls creating an enclosed hollow space;

b) first means adjacent a first end of said block to enable said block to be connected to an adjacent block;

c) second means adjacent a second end of said block to engage said first means of an adjacent block to enable said connected blocks to form an interlocked retaining wall;

whereby said light-weight, generally L-shaped, hollow blocks may be easily positioned to form said interlocked retaining wall and then fill is added to each said hollow block within said enclosed hollow space to provide resistance to forces associated with soil erosion control.

2. The soil erosion controlling block of claim 1 wherein said first means comprises a protrusion formed on said first end and said second means comprises a complementarily shaped recess which receives said protrusion.

3. The soil erosion controlling block of claim 2 further comprising a rod extending between an opening formed in said protrusion and an opening formed in said recess to interconnect said adjacent blocks against lateral movement relative to each other.

4. The soil erosion controlling block of claim 1 wherein said block is made of polyethylene.

5. The soil erosion controlling block of claim 1 wherein at least two lateral faces of said L-shaped block are formed with alternating grooves and ribs, said grooves providing passageways for fluid runoff and said ribs providing reinforcement.

6. The soil erosion controlling block of claim 1 further comprising channels in a bottom surface portion of said block such that when a second block is stacked upon first block, said channels accommodate rebar securing said first block to a ground portion adjacent said retaining wall.

7. The soil erosion controlling block of claim 6 further comprising openings in horizontal surfaces of said L-shaped block for receiving rebar to lock said second stacked block to said first block and said first block to the ground.

8. The soil erosion controlling block of claim 1 wherein said fill is selected from the group consisting of soil, sand, rock, water, and cement.

9. The soil erosion controlling block of claim 1 wherein said L-shaped blocks are offset stacked to create a terraced upper surface.

10. A method of creating a soil retaining wall comprising the steps of a) forming a first tier of a retaining wall by laterally inteconnecting a series of hollow L-shaped plastic blocks;

b) attaching said first tier to a ground portion;

c) offset stacking subsequent tiers of said retaining wall on said first tier by positioning each tier such that seams between adjacent interconnected blocks are offset from said adjacent tier;

d) interconnecting and attaching each subsequent tier of said retaining wall to the tier immediately beneath said subsequent tier;

e) cutting at least one hole in each hollow block in each tier;

f) filling each said hollow block with fill sellected from the group consisting of soil, sand, rock, water, and cement.

11. The method of creating a soil retaining wall of claim 10 wherein said step of connecting said first tier of the retaining wall to the ground portion comprises inserting rebar vertically through said block and horizontally through said block into the ground portion.

12. The method of creating a soil retaining wall of claim 10 wherein said interconnecting and attaching step comprises inserting rebar which extends between a first lower tier and a subsequent tier placed thereon.

13. The method of creating a soil retaining wall of claim 10 further comprising the step of sealing said at least one hole in each hollow block after said filling is completed.

14. The method of creating a soil retaining wall of claim 13 wherein said sealing step comprises spin welding portions of said plastic block which were removed to create said at least one hole into the resultant opening to complete an enclosure.

* * * * *